US006644785B2

(12) United States Patent
Elrod et al.

(10) Patent No.: US 6,644,785 B2
(45) Date of Patent: Nov. 11, 2003

(54) SOLID BI-LAYER STRUCTURES FOR USE WITH HIGH VISCOSITY INKS IN ACOUSTIC INK IN ACOUSTIC INK PRINTING AND METHODS OF FABRICATION

(75) Inventors: Scott A. Elrod, La Honda, CA (US); Babur B. Hadimioglu, Mountain View, CA (US); David Steinmetz, Linnwood, WA (US); Kaiser H. Wong, Torrance, CA (US)

(73) Assignee: Xerox Corporation, Stamford, CT (US)

( * ) Notice: Subject to any disclaimer, the term of this patent is extended or adjusted under 35 U.S.C. 154(b) by 4 days.

(21) Appl. No.: 09/957,710

(22) Filed: Sep. 19, 2001

(65) Prior Publication Data

US 2002/0015074 A1 Feb. 7, 2002

Related U.S. Application Data

(62) Division of application No. 09/218,924, filed on Dec. 22, 1998, now Pat. No. 6,416,678.

(51) Int. Cl.[7] ..... B41J 2/135
(52) U.S. Cl. ..... 347/46
(58) Field of Search ..... 347/46

(56) References Cited

U.S. PATENT DOCUMENTS

| | | | | |
|---|---|---|---|---|
| 3,211,088 A | | 10/1965 | Naiman | |
| 4,575,737 A | | 3/1986 | Vermot-Gaud et al. | |
| 4,748,461 A | | 5/1988 | Elrod | |
| 4,751,529 A | | 6/1988 | Elrod et al. | |
| 4,751,534 A | | 6/1988 | Elrod et al. | |
| 5,041,849 A | * | 8/1991 | Quate et al. | 347/46 |
| 5,520,715 A | | 5/1996 | Oeftering | |
| 5,565,113 A | * | 10/1996 | Hadimioglu et al. | 216/2 |
| 5,580,827 A | | 12/1996 | Akamine | |
| 5,591,490 A | | 1/1997 | Quate | |
| 5,593,486 A | | 1/1997 | Oliver et al. | |
| 5,631,678 A | * | 5/1997 | Hadimioglu et al. | 347/46 |
| 5,643,357 A | | 7/1997 | Breton et al. | |
| 5,667,568 A | | 9/1997 | Sacripante et al. | |
| 5,693,128 A | | 12/1997 | Sacripante et al. | |
| 5,694,684 A | | 12/1997 | Yamamoto | |
| 5,698,017 A | | 12/1997 | Sacripante et al. | |
| 5,809,646 A | | 9/1998 | Reinecke et al. | |
| 6,036,874 A | | 3/2000 | Farnaam | |
| 6,045,208 A | | 4/2000 | Hirahara et al. | |
| 6,336,707 B1 | * | 1/2002 | Asai et al. | 347/46 |

FOREIGN PATENT DOCUMENTS

| | | |
|---|---|---|
| EP | 0 272 155 A2 | 12/1987 |
| EP | 0 728 584 A2 | 8/1996 |
| JP | 58187366 A | 11/1983 |
| JP | 04142940 A | 5/1992 |
| JP | 10016236 A | 1/1998 |

* cited by examiner

*Primary Examiner*—Stephen D. Meier
*Assistant Examiner*—Michael S. Brooke
(74) *Attorney, Agent, or Firm*—Fay, Sharpe, Fagan, Minnich & McKee, LLP

(57) ABSTRACT

Low acoustic solid wave attenuation structures are formed with an electroformed nickel mold, and are incorporated within acoustic ink emitters, between the focusing lens and surface of an ink layer. The structures have characteristics of low attenuation of acoustic waves to increase the efficiency of acoustic wave transmission within the acoustic ink emitter. Using the described structures, acoustic ink printers can accurately emit materials having high viscosity, including hot melt inks.

19 Claims, 4 Drawing Sheets

SOLID BI-LAYER STRUCTURES FOR USE WITH HIGH VISCOSITY INKS IN ACOUSTIC INK IN ACOUSTIC INK PRINTING AND METHODS OF FABRICATION

This is a divisional of U.S. patent application Ser. No. 09/218,924, entitled SOLID BI-LAYER STRUCTURES FOR USE WITH HIGH VISCOSITY INKS IN ACOUSTIC INK PRINTING AND METHODS OF FABRICATION, filed Dec. 22, 1998 now U.S. Pat. No. 6,416,678.

BACKGROUND OF THE INVENTION

This invention relates to acoustic ink printing and, more particularly, to acoustic ink printing with hot melt inks.

Acoustic ink printing is a promising direct marking technology because it does not require the nozzles of the small ejection orifices which have been a major cause of the reliability and pixel placement accuracy problems that conventional drop on demand and continuous stream ink jet printers have experienced.

It has been shown that acoustic ink printers that have print heads comprising acoustically illuminated spherical or Fresnel focusing lenses can print precisely positioned picture elements (pixels) at resolutions which are sufficient for high quality printing of complex images. See, for example, the co-pending and commonly assigned U.S. Pat. No. 4,751,529 on "Microlenses for Acoustic Printing", and U.S. Pat. No. 4,751,530 on "Acoustic Lens Arrays for Ink Printing" to Elrod et al., which are both hereby incorporated by reference. It also has been found that the size of the individual pixels printed by such a printer can be varied over a significant range during operation.

Although acoustic lens-type droplet emitters currently are favored, there are other types of droplet emitters which may be utilized for acoustic ink printing, including (1) piezoelectric shell transducers or an acoustic lens-type drop emitter, such as described in Lovelady et al U.S. Pat. No. 4,308,547, which issued Dec. 29, 1981 on a "Liquid Drop Emitter," and (2) interdigitated transducer (IDT's), such as described in commonly assigned U.S. Pat. No. 4,697,195 on "Nozzleless Liquid Droplet Ejectors", to Quate et al. Furthermore, acoustic ink printing technology is compatible with various print head configurations; including (1) single emitter embodiments for raster scan printing, (2) matrix configured arrays for matrix printing, and (3) several different types of page width arrays, ranging from (I) single row, sparse arrays for hybrid forms of parallel/serial printing, to (ii) multiple row staggered arrays with individual emitters for each of the pixel positions or addresses within a page width address field (i.e., single emitter/pixel/line) for ordinary line printing.

For performing acoustic ink printing with any of the aforementioned droplet emitters, each of the emitters launches a converging acoustic beam into a pool of ink, with the angular convergence of the beam being selected so that it comes to focus at or near the free surface (i.e., the liquid/air interface) of the pool. Moreover, controls are provided for modulating the radiation pressure which each beam exerts against the free surface of the ink. That permits the radiation pressure of each beam to make brief, controlled excursions to a sufficiently high pressure level to overcome the restraining force of surface tension, whereby individual droplets of ink are emitted from the free surface of the ink on command, with sufficient velocity to deposit them on a nearby recording medium.

Hot melt inks have the known advantages of being relatively clean and economical to handle while they are in a solid state and of being easy to liquify in situ for the printing of high quality images. Another advantage lies in that there is no need to dry paper (as in water-based inks) and no bleeding of different colors. These advantages are of substantial value for acoustic ink printing, especially if provision is made for realizing them without significantly complicating the acoustic ink printing process or materially degrading the quality of the images that are printed.

A drawback of using hot melt inks in acoustic ink printing is that such inks have a relatively high viscosity. Particularly, the inks can be in the form of, but are not limited to, a solid material at room temperature and are liquidified at elevated temperatures to achieve a viscosity of approximately 5–10 cp. When hot melt inks are used to fill in the complete focal zone of an acoustic lens, as is the case with a standard acoustic ink printer, significant acoustic attenuation occurs in the focal path. This will, therefore, require that the input power to a printer be raised to a much higher level to overcome the attenuation, which in turn results in increased power consumption and stress on the system. When too much of an acoustic wave is attenuated, it is not possible to emit ink drops, or undesirable undeformed, or misdirected ink drops with very low velocity are generated. FIG. 1 provides a view of an exemplary acoustic ink printing element 10 to which the present invention may be applied. Of course, other configurations may also have the present invention applied thereto.

As shown, the element 10 includes a glass layer 12 having an electrode layer 14 disposed thereon. A piezoelectric layer 16, preferably formed of zinc oxide, is positioned on the electrode layer 14 and an electrode 18 is disposed on the piezoelectric layer 16. Electrode layer 14 and electrode 18 are connected through a surface wiring pattern representatively shown at 20 and cables 22 to a radio frequency (RF) power source 24 which generates power that is transferred to the electrodes 14 and 18. On a side opposite the electrode layer 14, a lens 26, preferably a concentric Fresnel lens, is formed. Spaced from the lens 26 is a liquid level control plate 28, having an aperture 30 formed therein. Ink 32 is retained between the liquid level control plate 28, having an aperture 30 formed therein. Ink 32 is retained between the liquid level control plate 28 and the glass layer 12, and the aperture 30 is aligned with the lens 26 to facilitate emission of a droplet 34 from ink surface 36. Ink surface 36 is, of course, exposed by the aperture 30.

The lens 26, the electrode layer 14, the piezoelectric layer 16, and the electrode 18 are formed on the glass layer 12 through known photolithographic techniques. The liquid level control plate 28 is subsequently positioned to be spaced from the glass layer 12. The ink 32 is fed into the space between the plate 28 and the glass layer 12 from an ink supply (not shown).

A droplet emitter is disclosed in commonly assigned U.S. Patent to Hadimioglu et al. U.S. Pat. No. 5,565,113, entitled "Lithographically Defined Ejection Units" and in commonly assigned U.S. Pat. No. 5,591,490 to Quate entitled "Acoustic Deposition of Material Layers", both hereby incorporated by reference.

While the above concepts provide advantages, drawbacks exist. Particularly, an ink print head in which the above device is implemented is required to perform repetitive tasks at a high level of frequency. Further, such a device is implemented in a hostile environment with large fluctuations in heat and operating parameters. Therefore, there is a concern as to the robustness of the liquid cell when used in a print head. Particularly, there are concerns that use of the capping structure may be insufficient to maintain the integrity of the liquid cell. Another drawback is the difficulty of filling the liquid cell with a layer of liquid so as to maintain the liquid cell free from air pockets or bubbles which would disrupt the acoustic waves traveling through the liquid cell.

In view of the above, it is considered desirable to develop an emitter in an acoustic ink print head which can emit hot melt ink. The print head should be robust and able to operate with a high degree of reliability, is economical to make, and is manufactured consistent with fabrication techniques of existing acoustic ink print heads.

SUMMARY OF THE INVENTION

The present invention describes bi-layer structures integrated into individual emitters of an acoustic ink print head which enables the print head to emit droplets of high viscosity fluid such as hot melt inks. The bi-layer structure is provided above the glass substrate but below the ink surface of the acoustic ink emitter and is used to avoid attenuation of acoustic waves which would occur in a reservoir full of high-viscosity fluids. Also disclosed is a method of fabricating the bi-layer structures.

A benefit of the present invention is an improvement in the accuracy and functionality of an acoustic ink print head which is intended to emit droplets of a high-viscosity fluid such as hot melt inks.

Another benefit of the present invention is that such a structure is compatible with present fabrication techniques for acoustic ink print heads wherein emitters are beneficially lithographically defined and formed using conventional thin-film processing (such as vacuum deposition, epitaxial growth, wet etching, dry etching, and plating).

These together with other objects of the invention, along with the various features of novelty which characterize the invention, are pointed out with particularity in the claims annexed to and forming a part of this disclosure. For a better understanding of the invention, its operating advantages and the specific objects obtained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annex drawings wherein.

DETAILED DESCRIPTION OF THE PREFERRED EMBODIMENTS

Figure 1:
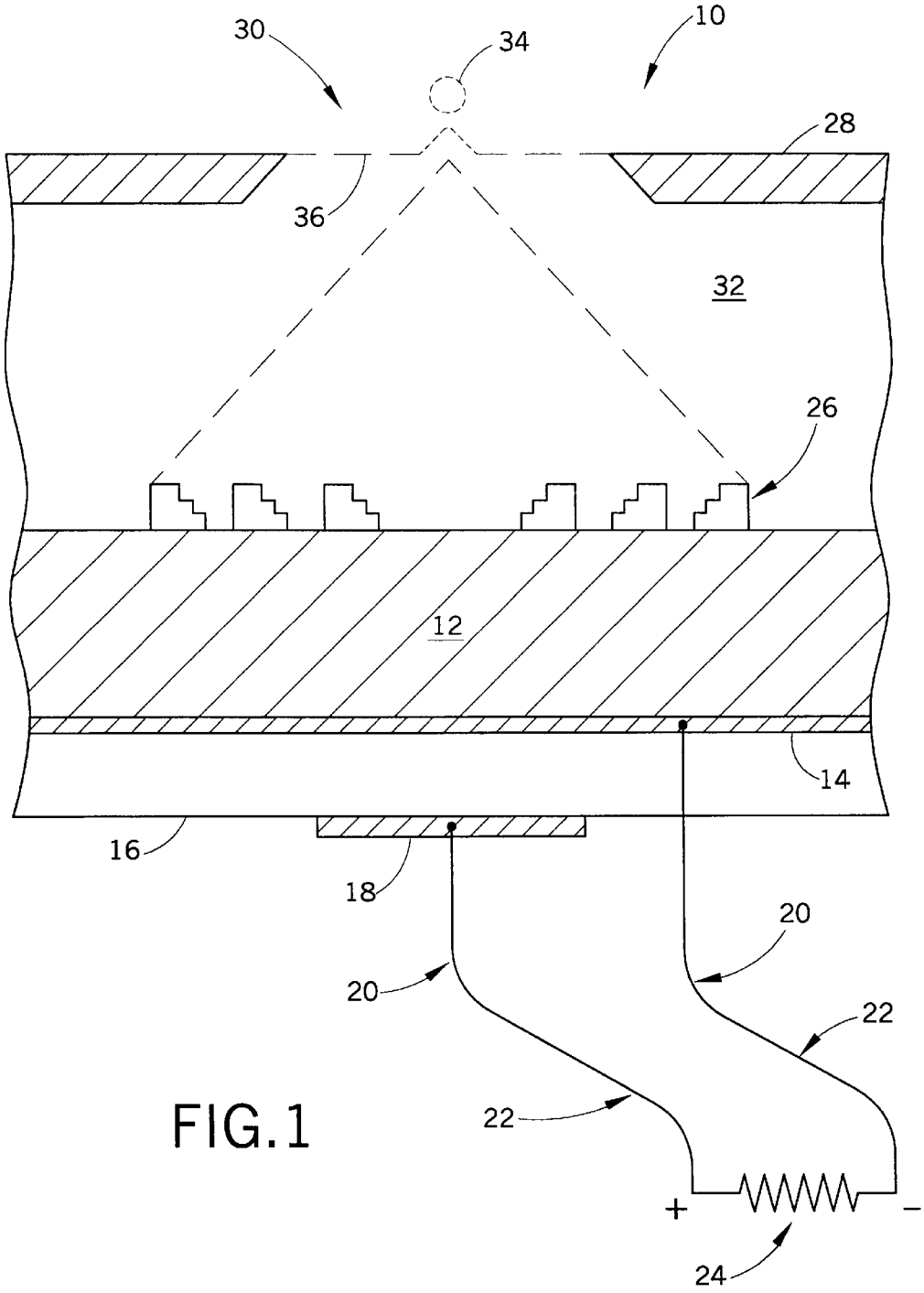
FIG. 1 is a cross-sectional view of an acoustic ink emitter including a liquid cell filled with a relatively low attenuation liquid.

As an acoustic ink emitter has been described in some detail in connection with FIG. 1, the following descriptions of multiple or single acoustic ink emitters are shown in a more simplified depiction. It is to be appreciated, however, that the following embodiments are intended to be incorporated within known acoustic ink print heads including emitters such as described in FIG. 1.

Referring now to FIGS. 2A–2E, steps in a fabrication process are illustrated for forming a pedestal carrier with pedestals having the acoustic properties of low sound velocity and low attenuation of acoustic energy. The pedestal carrier to be described below is intended to be incorporated within an acoustic ink print head in order to allow the print head to function with high viscosity fluids such as phase-change inks, including hot melt inks. In phase-change acoustic ink printing, the loss of acoustic energy from a lens, such as a Fresnel lens, to meniscus of an ink at the aperture where the ink emission takes place, is extremely large due to the high viscosity of the molten wax of the hot melt ink. In order to reduce the acoustic loss, a solid layer of material with low attenuation of acoustic energy and low sound velocity is used to replace a significant area originally occupied by the hot melt ink located between the lens and an upper plate.

The immediately following discussion proposes a fabrication process to build the structure which will maintain the acoustic energy, and at the same time minimize hindrance to the ink flow inside a print head.

Figure 2A:
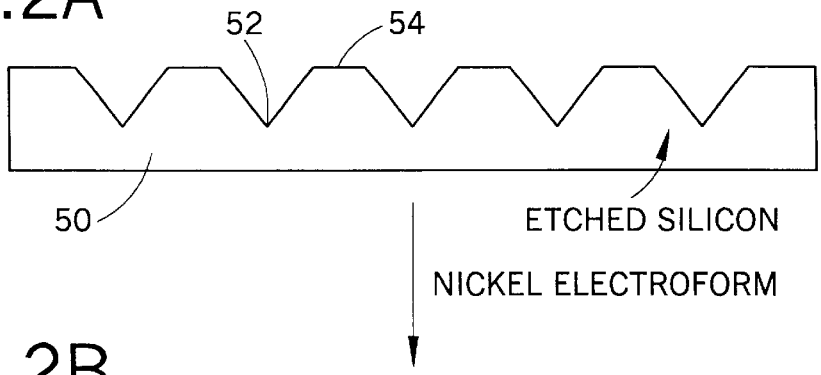
FIGS. 2A–2E illustrate the steps in the formation of a pedestal for use in an acoustic ink printer of the present invention.

Turning attention to FIG. 2A, a substrate 50 has been etched by an existing etching technique, including those techniques known in wet etching and dry etching. The substrate etching results in a desired form of an upper surface of repeating v-channels 52 and flat planar portions 54. Etched substrate 50 may be a silicon or other known material used in mold formation. Also, while etching has been used in this embodiment, it would be within one of ordinary skill in the art to use other known techniques to obtain substrate 50.

Figure 2B:
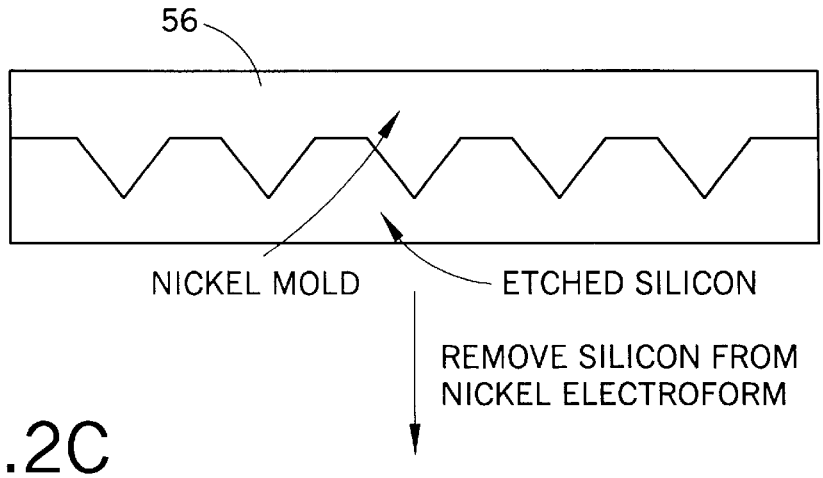
Figure 2C:
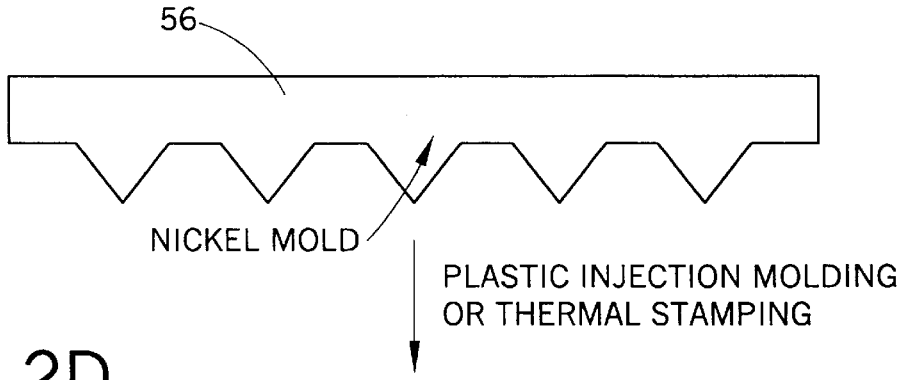

In FIG. 2B, a layer of nickel or other material which can be used as the mold is deposited on the upper surface of etched substrate 50. The nickel is deposited in accordance with known electroforming processes, to form nickel mold 56. The etched silicon 50 and electroformed nickel mold 56 are separated, as disclosed in FIG. 2C. Removal of silicon substrate 50 can be accomplished by a variety of procedures including dissolving the silicon, pulling apart the silicon and nickel halves, or other known techniques.

Figure 2D:
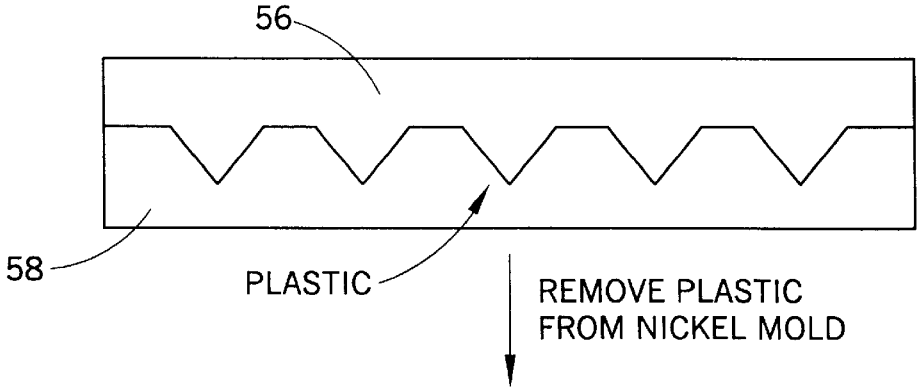

The electroformed nickel mold 56 is then used as part of an injection molding process or as part of a thermal stamp process, in order to form a material, such as plastic, into a solid low acoustic wave attenuation element 58, as shown in FIG. 2D. Whatever material is selected to form the solid low acoustic wave attenuation element 58, it is desirable that it have the characteristic of low attenuation of acoustic energy.

Figure 2E:
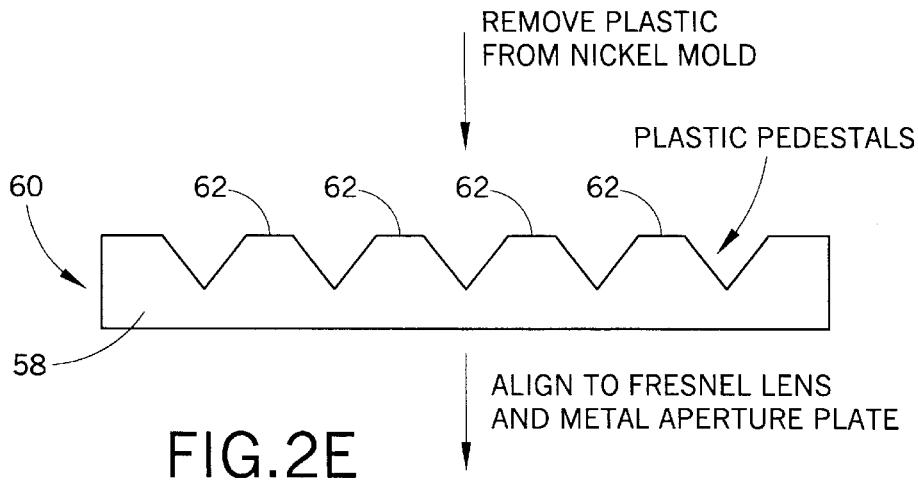

In FIG. 2E, the solid element 58 is shown separated from electroformed nickel mold 56 illustrating the formation of a pedestal carrier 60, having a plurality of pedestals 62. The implementation of the pedestal carrier 60 and its integration into an acoustic ink print head is illustrated in the simplified view of FIG. 3. As previously noted, for simplification, some of the elements of acoustic ink print head 70 are shown in block form.

Figure 3:
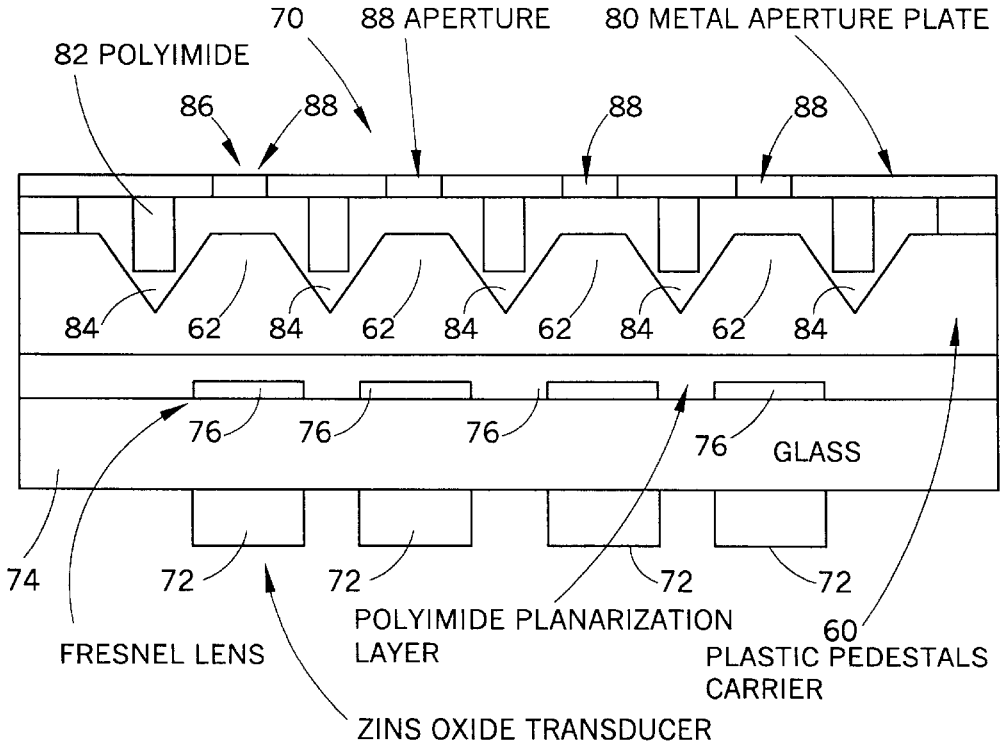
FIG. 3 illustrates the pedestal carrier of FIG. 2 within an acoustic ink printer configuration.

Acoustic ink print head 70 of FIG. 3 includes commonly used and configured transducers 72, a base such as glass substrate 74, and acoustic lenses, such as Fresnel lenses 76. A polyimide planerization layer 78 is deposited over Fresnel lenses 76, and pedestal carrier 60 is positioned and attached on polyimide planerization layer 78. A metal aperture plate 80 is located on the top surface of pedestal carrier 60 and spacers such as polyimide spacers 82 can be placed within v-channels 84 of pedestal carrier 60 as supports for metal aperture plate 80. A hot melt ink 86 is made to flow between the upper surfaces of pedestal carrier 60 and the lower surface of metal aperture plate 80, which is also formed to provide for aperture 88, past which ink drops are emitted. Alternatively, the ink could be allowed to refill under capillary forces only as droplets are ejected.

In operation, when any one of transducers 72 are energized by an RF source (not shown), the acoustic energy from the energized transducer 72 passes through base 74 to acoustic lens 76. Each acoustic lens passes the acoustic energy through the polyimide planerization level 78 and pedestal 62 of pedestal carrier 60, and then the beam converges to a small focal area at the ink surface. Without the implementation of pedestal carrier 60 with pedestals 62, the acoustic waves would travel through a longer path of a high-viscosity material, i.e. the hot melt ink. As previously noted, materials having high viscosity such as hot melt ink have a detrimental effect on the transmission of acoustic energy due to their high attenuation of acoustic waves. However, in the present embodiment, the plastic material of pedestals 62 provides a lower attenuation path for the acoustic waves, thereby resulting in an increased percentage of energy transference to the ink surface (i.e., the meniscus) 86*a*. The foregoing results in an improved transmission efficiency of the acoustic energy for emitting ink drops.

It is to be appreciated that the pedestal height can be reduced, thus increasing the pedestal planar portion to ensure total coverage of the acoustic transmission wave and to increase ink flow if necessary. Specifically, by lowering the height of the pedestal, more area will be provided for ink flow.

The sidewalls of the pedestals will be defined having precise angles as will be determined by anisotropic etching of the silicon. The planar top portion of the pedestal needs to be as wide or slightly wider than the acoustic beam at the pedestal height, to allow the acoustic beam to pass undistorted.

Pedestal carrier 60 meets the acoustic requirements of high acoustic transmission and may be injection-molded with polypheneylene sulfide or a kevlar/nylon composite. Additionally, pedestal carrier 60 can be constructed using lithographic processes, such as those disclosed in U.S. Pat. No. 5,565,113 to Hadimioglu et al. on "Lithographically Defined Ejection Units, hereby incorporated by reference. The present figures show spacer 82 at each of the v-channels 84. Alternatively, this plate support can be provided in less than all of the channels, or the plate could be attached only outside the lens region so it is not attached to any channel.

Figure 4:
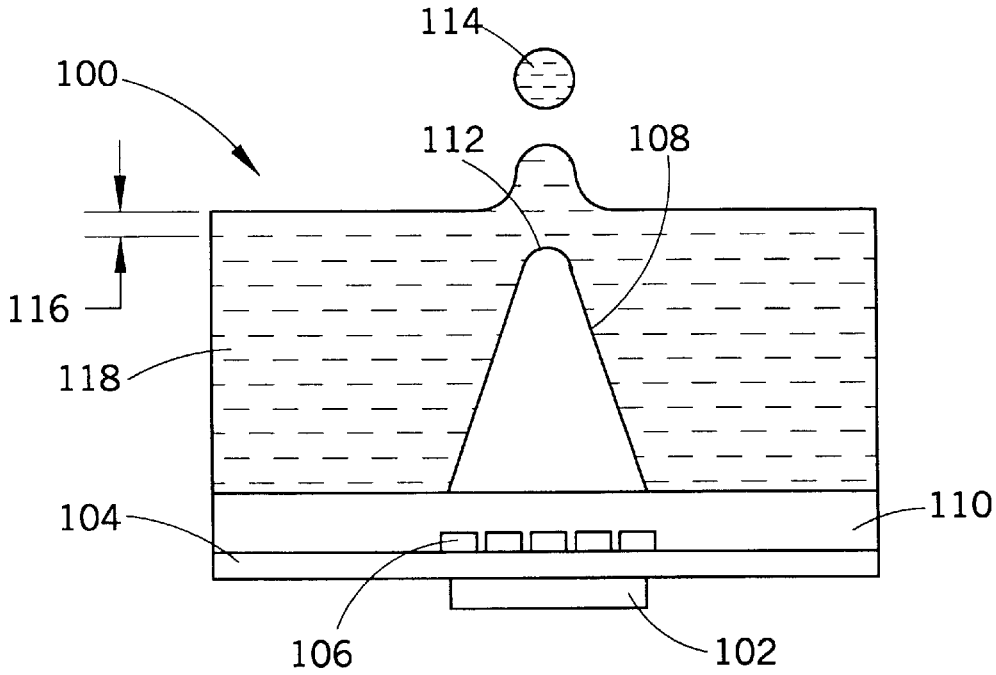
FIG. 4 is a side view of a near-field type probe within an acoustic ink emitter.

Turning attention to FIG. 4, another embodiment of the present invention is illustrated. Particularly, shown is a simplified depiction of a near-field probe which may be implemented in accordance with the teachings of the present invention. FIG. 4 shows a single acoustic ink emitter 100. In this embodiment, acoustic ink emitter 100 includes among other elements, a transducer 102, base 104 and acoustic lens 106. Above lens 106 is near-field probe 108 carried on probe carrier 110. The probe carrier 110 can be constructed and integrated into acoustic ink emitter 100 in a manner similar to that described in connection with the forgoing embodiment. In this embodiment, near-field probe 108 replaces the pedestal formation of FIG. 3. Near-field probe 108 has a tip 112 which is made smaller than a diameter of an emitted drop 114. By this construction, the acoustic waves will diffract off of tip 112, and therefore the thickness level 116 of ink 118 above tip 112 should be equal to or less than the desired drop diameter. It is to be appreciated tip 112 may have various configurations including but not limited to a rounded tip.

Near-field probe 108 can be made of the same material as the pedestals of FIG. 3, and in particular those materials which provide a low acoustic attenuation for sound waves traveling therethrough. Thus, it is to be appreciated that the width of the near-field probe is designed such that at least selected portions of the acoustic waves travel within the probe body.

Benefits of the present embodiment are that the RF frequency does not determine the drop size and therefore the RF frequency can be lowered to obtain a lower attenuation in the liquid or a higher viscosity fluid can be used. In order to achieve low-loss focusing from transducer 102, it will be desirable to have the length of the near-field probe 108 significantly longer than a wavelength of the acoustic waves being transmitted. This distance would, most likely be on the order of a few millimeters. It is also noted that in this embodiment, the acoustic wave intensity will decrease with $r^{-2}$ dependence, where r is the distance measured from tip 112 to the surface of the ink. Therefore, to maintain the acoustic intensity at the ink surface within ±10%, the ink thickness will be kept within ±0.5 $\mu$m, assuming that the ink thickness is approximately 10 $\mu$m. A benefit of the present embodiment shown in FIG. 4 is that it allows an increase in the amount of ink which can be held in the reservoir. Specifically, there is less structure and therefore more area for the hot melt ink.

Figure 5:
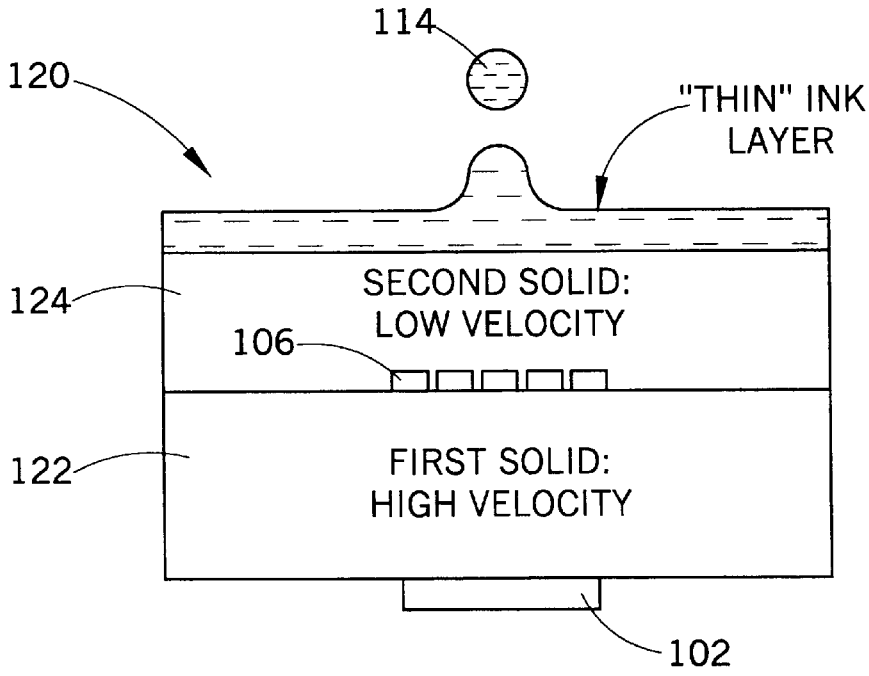
FIG. 5 is a two-layer solid structure for focusing an acoustic wave within an acoustic ink emitter.

Turning attention to FIG. 5, a further embodiment of the present invention is disclosed. This embodiment is directed to focusing the acoustic waves in a solid material. As with the previous descriptions, the main concept is to print with materials having a relatively high viscosity, such as hot melt inks, which may be solid at room temperature and liquefy at elevated temperatures to achieve a viscosity of about 5–10 cp. In the embodiment of FIG. 5, the majority of the focal path is comprised of solid material that has the properties of a low acoustic loss and low sound velocity.

The low attenuation characteristic of the solids assure that attenuation of acoustic sound waves of emitter 120 will be lowered, thereby reducing the amount of input power required. Low sound velocity is desired so that there will be a significant change in the sound velocity from first solid 122 to second solid bi-layer material 124. Such a construction also increases the ease of the fabrication of Fresnel lens 106.

Materials having acceptable properties include polyphenylene sulfide. This material can be cast, spun, molded, or otherwise attached to first solid 122. Additionally, if desirable the top surface can be polished to achieve a planer top surface. The embodiment of FIG. 5 can be further modified by removing significant amounts of bi-layer material 124 at locations other than for the small areas on the lenses to increase the fluid path for the ink layer 118 on top of solid bi-layer material 124. This configuration can be achieved by various fabrication techniques including molding.

Ink layer 118 will be significantly thinner than that of other embodiments, whereby reduced acoustic attenuation throughout the entire subsurface is achieved.

With respect to the above description then, it is to be realized that the optimal dimensional relationships for the parts of the invention, to include variations in size, materials, shape, form, function and manner of operation, assembly and use are deemed readily apparent and obvious to one skilled in the art and all equivalent relations to those illustrated in the drawings and described in the specification are intended to be encompassed by the present invention.

Therefore, the forgoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to falling within the scope of the invention.

In consideration thereof, we claim:

1. An acoustic emitter comprising:

base structure having a top surface and a bottom surface;

a transducer intimately attached to a bottom surface of the base;

an energy source connected across the transducer to generate acoustic waves which are transmitted from the transducer through the base;

an acoustic lens formed on an upper surface of the base at a location over the transducer, wherein the acoustic waves transmitted through the base are transmitted to the acoustic lens which focuses the acoustic waves into a small focal area;

a solid low acoustic wave attenuation element located above the acoustic lens, wherein the solid low acoustic wave attenuation element is a pedestal carrier having at least one pedestal including inwardly angled walls and a planar top portion;

an aperture plate arranged above the solid low acoustic wave attenuation element; and a reservoir of fluid located between an upper surface of the solid low acoustic wave attenuation element and a lower surface of the aperture plate, wherein the focused acoustic waves are passed through the solid low acoustic wave attenuation element and into the reservoir of fluid having sufficient acoustic energy to cause a fluid drop to be emitted from the reservoir.

2. The acoustic emitter according to claim 1 further including a polyimide planarizing layer located between the acoustic lens and the solid low acoustic wave attenuation element.

3. The acoustic emitter according to claim 1 wherein the angled walls are distanced from each other such that at least selected portions of the acoustic waves from the acoustic lens are located within an area defined by the angled walls, the selected portions of the acoustic waves being sufficient to emit the fluid drop.

4. The acoustic ink emitter according to claim 1 wherein the reservoir of fluid is filled with a hot melt ink.

5. An acoustic emitter comprising:

a base structure having a top surface and a bottom surface;

a transducer intimately attached to a bottom surface of the base;

an energy source connected across the transducer to generate acoustic waves which are transmitted from the transducer through the base;

an acoustic lens formed on an upper surface of the base at a location over the transducer, wherein the acoustic waves transmitted through the base are transmitted to the acoustic lens which focuses the acoustic waves into a small focal area;

a solid low acoustic wave attenuation element located above the acoustic lens, wherein the solid low acoustic wave attenuation element is a pedestal carrier having at least one pedestal including a planar top portion, and a length of the planar top portion of the at least one pedestal is at least as long as a wavelength of the acoustic waves passing therethrough;

an aperture plate arranged above the solid low acoustic wave attenuation element; and a reservoir of fluid located between an upper surface of the solid low acoustic wave attenuation element and a lower surface of the aperture plate, wherein the focused acoustic waves are passed through the solid low acoustic wave attenuation element and into the reservoir of fluid having sufficient acoustic energy to cause a fluid drop to be emitted from the reservoir.

6. An acoustic emitter comprising:

a base structure having a top surface and a bottom surface;

a transducer intimately attached to a bottom surface of the base;

an energy source connected across the transducer to generate acoustic waves which are transmitted from the transducer through the base;

an acoustic lens formed on an upper surface of the base at a location over the transducer, wherein the acoustic waves transmitted through the base are transmitted to the acoustic lens which focuses the acoustic waves into a small focal area;

a solid low acoustic wave attenuation element located above the acoustic lens, wherein the solid low acoustic wave attenuation element is a pedestal carrier having at least one pedestal including a planar top portion and the at least one pedestal is arranged to be completely submerged in the reservoir of fluid;

an aperture plate arranged above the solid low acoustic wave attenuation element: and a reservoir of fluid located between an upper surface of the solid low acoustic wave attenuation element and a lower surface of the aperture plate, wherein the focused acoustic waves are passed through the solid low acoustic wave attenuation element and into the reservoir of fluid having sufficient acoustic energy to cause a fluid drop to be emitted from the reservoir.

7. An acoustic emitter comprising:

a base structure having a top surface and a bottom surface;

a transducer intimately attached to a bottom surface of the base;

an energy source connected across the transducer to generate acoustic waves which are transmitted from the transducer through the base;

an acoustic lens formed on an upper surface of the base at a location over the transducer, wherein the acoustic waves transmitted through the base are transmitted to the acoustic lens which focuses the acoustic waves into a small focal area;

a solid low acoustic wave attenuation element located above the acoustic lens, wherein the solid low acoustic wave attenuation element is a near-field probe which has a rounded end tip;

an aperture plate arranged above the solid low acoustic wave attenuation element; and a reservoir of fluid located between an upper surface of the solid low acoustic wave attenuation element and a lower surface of the aperture plate, wherein the focused acoustic waves are passed through the solid low acoustic wave attenuation element and into the reservoir of fluid having sufficient acoustic energy to cause a fluid drop to be emitted from the reservoir.

8. The acoustic emitter according to claim 7 wherein the rounded end tip is made to be smaller than a desired drop size.

9. The acoustic emitter according to claim 9 wherein the length of the near-field probe is designed such that the thickness of the fluid layer above the rounded end tip is equal to or less than the diameter of the desired drop.

10. The acoustic emitter according to claim 8 wherein the near-field probe is of a length greater than a wavelength of the acoustic waves being transmitted.

11. An acoustic emitter comprising:

a base structure having a top surface and a bottom surface;

a transducer intimately attached to a bottom surface of the base;

an energy source connected across the transducer to generate acoustic waves which are transmitted from the transducer through the base;

an acoustic lens formed on an upper surface of the base at a location over the transducer, wherein the acoustic waves transmitted through the base are transmitted to the acoustic lens which focuses the acoustic waves into a small focal area;

a solid low acoustic wave attenuation element located above the acoustic lens, wherein the solid low acoustic wave attenuation element is a solid bi-layer consisting of a first layer of a high velocity material and a second layer of a low velocity material;

an aperture plate arranged above the solid low acoustic wave attenuation element; and a reservoir of fluid located between an upper surface of the solid low acoustic wave attenuation element and a lower surface of the aperture plate, wherein the focused acoustic waves are passed through the solid low acoustic wave attenuation element and into the reservoir of fluid having sufficient acoustic energy to cause a fluid drop to be emitted from the reservoir.

12. An acoustic emitter comprising:

an acoustic lens formed on the first surface of the base, wherein the acoustic waves transmitted through the base are transmitted to the acoustic lens which focuses the acoustic waves;

a solid low acoustic wave attenuation element located above the acoustic lens, wherein the solid low acoustic wave attenuation element is a pedestal carrier having at least one pedestal including inwardly angled walls and a planar top portion, the angled walls distanced from each other such that at least selected portions of the acoustic wave from the acoustic lens is located within an area defined by the angled walls, the selected portions of the acoustic wave being sufficient to emit a fluid drop; and a reservoir of fluid located above an upper surface of the solid low acoustic wave attenuation element, wherein the focused acoustic waves are passed through the solid low acoustic wave attenuation element and into the reservoir of fluid having sufficient acoustic energy to cause the fluid drop to be emitted from the reservoir.

13. The acoustic emitter according to claim 12 further including a polyimide planarizing layer located between the acoustic lens and the solid low acoustic wave attenuation element.

14. An acoustic emitter comprising:

an acoustic lens formed on the first surface of the base, wherein the acoustic waves transmitted through the base are transmitted to the acoustic lens which focuses the acoustic waves;

a solid low acoustic wave attenuation element located above the acoustic lens, wherein the solid low acoustic wave attenuation element is at least one of a near-field probe which has a rounded end tip made to be smaller than a desired drop size or a solid bi-layer consisting of a first layer of a high velocity material and a second layer of a low velocity material; and a reservoir of fluid located above an upper surface of the solid low acoustic wave attenuation element, wherein the focused acoustic waves are passed through the solid low acoustic wave attenuation element and into the reservoir of fluid having sufficient acoustic energy to cause the fluid drop to be emitted from the reservoir.

15. The acoustic emitter according to claim 14 further including a polyimide planarizing layer located between the acoustic lens and the solid low acoustic wave attenuation element.

16. The acoustic emitter according to claim 12 wherein the angled walls are distanced from each other such that at least selected portions of the acoustic waves from the acoustic lens located within an area defined by the angled walls, the selected portions of the acoustic waves being sufficient to emit the fluid drop.

17. The acoustic emitter according to claim 12 wherein the reservoir of fluid is filled with a hot melt ink.

18. The acoustic emitter according to claim 12, wherein the at least one pedestal is arranged to be completely submerged in the reservoir of fluid.

19. The acoustic emitter according to claim 14 wherein the reservoir of fluid is filled with a hot melt ink.

* * * * *

UNITED STATES PATENT AND TRADEMARK OFFICE

CERTIFICATE OF CORRECTION

PATENT NO. : 6,644,785 B2
DATED : November 11, 2003
INVENTOR(S) : Elrod et al.

It is certified that error appears in the above-identified patent and that said Letters Patent is hereby corrected as shown below:

Title page, Item [54] and Column 1, line 3,
delete "IN ACOUSTIC INK" so the Title reads as follows:
-- SOLID BI-LAYER STRUCTURES FOR USE WITH HIGH VISCOSITY INKS IN ACOUSTIC INK PRINTING AND METHODS OF FABRICATION --.

Signed and Sealed this

Ninth Day of March, 2004

JON W. DUDAS
*Acting Director of the United States Patent and Trademark Office*